US005951257A

United States Patent [19]

Matson

[11] Patent Number: 5,951,257

[45] Date of Patent: Sep. 14, 1999

[54] EASILY SERVICEABLE FAN WITH UNIVERSAL SUBFRAME ASSEMBLY AND TENSIONABLE GUARDS

[75] Inventor: Carl G. Matson, Little Rock, Ark.

[73] Assignee: Triangle Engineering of Arkansas Inc., Jacksonville, Ark.

[21] Appl. No.: 09/046,777

[22] Filed: Mar. 18, 1998

Related U.S. Application Data

[62] Division of application No. 08/650,483, May 20, 1996, Pat. No. 5,749,708.

[51] Int. Cl.[6] ..... F04D 29/18

[52] U.S. Cl. ..... 416/246

[58] Field of Search ..... 416/246, 247 R

[56] References Cited

U.S. PATENT DOCUMENTS

| | | | |
|---|---|---|---|
| 1,698,328 | 1/1929 | Duffie | 416/246 |
| 2,715,495 | 8/1955 | Bastian | 416/246 |
| 3,112,852 | 12/1963 | Norden et al. | 225/104 |
| 3,405,894 | 10/1968 | Jordan et al. | 416/246 |
| 4,120,615 | 10/1978 | Kemm et al. | 417/360 |
| 4,813,120 | 3/1989 | Fournier | 29/426.6 |
| 5,014,409 | 5/1991 | Hippach | 29/267 |
| 5,079,791 | 1/1992 | Grech | 7/169 |
| 5,348,447 | 9/1994 | Redetzke | 416/247 |
| 5,368,453 | 11/1994 | Peng | 417/423.5 |
| 5,480,282 | 1/1996 | Matson | 415/125 |

FOREIGN PATENT DOCUMENTS 579687 6/1933 Germany .

575561 2/1946 United Kingdom .

*Primary Examiner*—John Kwon

*Attorney, Agent, or Firm*—Stephen D. Carver

[57] ABSTRACT

A fan using tensionable safety guards combined with a universal subframe to enhance fan servicing. The preferred fan comprises a parallelepiped housing protectively enclosing an internal subframe securing a drive motor and fan propeller. A reinforcing edge circumscribes the housing front and rear to facilitate guard coupling. The edge comprises an angled brace adjacent to a peripheral lip penetrated by several spaced-apart slits. Fastener orifices penetrate the housing adjacent the slits. A displaceable clip resides in each slit. A clip anchor mates with a fastener that permits an operator to displace the clip outwardly and inwardly to selectively tension the safety guards that cover the housing front and rear. Each guard comprises a rectangular wire mesh. Each clip defines an arcuate cradle that captivates a portion of a safety guard. A transverse notch in each cradle captivates another portion of the guard to firmly seat it. The subframe comprises two parallel elongated brackets, each penetrated by several equidistant follower slots for securing at least one mounting chassis. The chassis comprises a base plate extending between integral slotted sides aligned with appropriate bracket slots to secure the chassis to the brackets. Each chassis base is penetrated by several mounting slots to receive drive motors, propellers, bearings and pulleys. An optional automated tensioning system may be used with belt-driven fans. Two springs pull one chassis from the other to maintain proper belt tension.

7 Claims, 13 Drawing Sheets

EASILY SERVICEABLE FAN WITH UNIVERSAL SUBFRAME ASSEMBLY AND TENSIONABLE GUARDS

This is a divisional application based upon prior Matson application Ser. No. 08/650,483, filed May 20, 1996, entitled Easily Serviceable Fan With Universal Subframe Assembly and Tensionable Guards, now U.S. Pat. No. 5,749,708.

BACKGROUND OF THE INVENTION

I. Field of the Invention

The present invention relates generally to industrial ventilation fans, especially those adapted for agricultural use. More particularly, my invention relates to a fan that utilizes tensionable guards coupling to the housing to form a rigid overall structure with an universal internal bracing system.

II. Description of the Prior Art

It has long been recognized in the fan arts that moving air may be conveniently used to ventilate an area while simultaneously cooling it. Thus, directed high velocity air is often used for both ventilation and cooling purposes in many applications. For example, high velocity fans often provide ventilation and cooling for many agricultural facilities, especially in the poultry and dairy industries.

To practically control the effects of such fans, it is desirable to control the direction, velocity, and volume of the air being driven. I have previously proposed a fan adept at controlling air over long ranges. My previous invention, issued as U.S. Pat. No. 5,480,282, on Jan. 2, 1996, and its teachings are hereby incorporated by reference. It was classified in U.S. Class 415, subclass 125. As can be seen from that patent and the prior art therein, the known prior art comprises many different types and designs of fans adapted to satisfy various criteria.

Fans have been used for controlling temperature and removing gases in agricultural buildings, such as poultry confinement houses, since the middle of this century. During this time period, countless changes have been made in the fans to improve both their installation and their resultant ventilation and cooling effects. The consequence of these changes has been the development of a wide variety of fans. The fan housings and accessories have become especially diverse.

For example, a common exhaust fan installed in a conventionally mounted parallelepiped housing may be equipped with screen guards, shutters, discharge cones, as well as an extensive variety of drive arrangements and blades. The same exhaust fan may also be installed in a slanted orientation and then combined with other accessories to perform a different ventilation or cooling task altogether.

To further complicate matters, many manufacturers offer identical fans for both intake and exhaust applications while others build different intake and exhaust fans. Others build completely different fans for different applications. Furthermore, each time a new method of routing air or installing fans comes into vogue, many fan manufacturers simply change their designs to conform to the latest style. The result of such random change is many individual fans with specialized components and accessories that have very little interchangeability.

As may well be imagined, such diversity among fans and components causes countless maintenance nightmares. For one, multiple parts must be kept "on hand" to properly service or repair fans. Moreover, the technician servicing the fan generally must possess knowledge of several different types and designs of fans. Yet another problem involves the protective safety guards installed on most fans.

Protective safety guards prevent objects from inadvertently contacting the fan blades during operation. Such guards typically comprise rectangular wire mesh screens installed on both sides of the fan housing. On most fans, the guards must be removed to service the fan. Then, the guards must be replaced tightly on the housing. Otherwise they get loose, eventually becoming deformed and ineffective. Deformed guards are also difficult to remove and install properly.

Furthermore, the more a fan is used, the "looser" the fan housing gets. Internal vibrations and/or rough handling eventually cause the housing to become deformed or warped. As a result, the guards simply do not "fit" the housing as tightly as they did when the fan was newer. Thus, provision must be made for tensioning the guards properly as the fans age to avoid premature deformation and breakdown. An ideal tensioning system must inherently reinforce the structural stability of the housing.

Another problem with known prior art belt-driven fans is the lack of a simple belt tensioning method. As the fans age, wear on the belts, motors and associated pulleys results in less belt tension and subsequently poorer fan performance. To maintain peak operating efficiency, belt tensioning must be performed more often for older fans. Tensioning of belt-driven fans generally requires the removal of at least one guard. Unfortunately, this type of routine maintenance requires considerable time and effort. Consequently, a desirable fan would automatically maintain traction on the belt to encourage peak operating efficiency.

SUMMARY OF THE INVENTION

My improved fan with universal subframe assembly comprises a fan that uses tensionable safety guards combined with a universal subframe to enhance fan servicing. An optional belt tensioner maintains peak operating tension on the drive belt. This improved fan overcomes several perceived problems with known prior art fans.

The invention also provides a uniform fan design that increases parts interchangeability within a given size of fans. It also standardizes component design between different sizes of fans. One mounting frame will accept mounting brackets that accommodate multiple bearing-motor combinations. The arrangement is also flexible in that placement of the bearing, motors, and drive pulleys may be reversed to locate the various components in-board or outboard as well as above or below.

The mounting chassis are also interchangeable and may be inverted when necessary. A further advantage of this design is the multiplicity of adjustments that are available. One advantage of having infinite adjustments is that the "V" drive belt size is no longer critical. In other words, one size of drive belt may be used for several different sizes and types of fans. Conversely, pulleys having widely differing diameters can also be installed without detriment. Consequently, component replacement in the field becomes much easier because many different sizes of components will fit properly. Another important feature of the present invention are the tensionable guards. This system permits selective tightening of the guards after maintenance as well as during assembly.

The fan comprises a generally parallelepiped housing protectively enclosing several internal fan components. The fan components include an internal venturi fitting adjacent a vertically oriented mounting subframe. The subframe secures the internal fan components inside the housing. A pair of detachable safety guards cover the front and rear housing faces.

The housing comprises a hollow, box-like frame separating an air intake end and a high velocity air output end. The frame has an open front and rear face bounding a parallel top and bottom and parallel side walls. A reinforcing edge circumscribes the frame adjacent each end. The edge comprises an angled brace adjacent to a peripheral lip. The lip is penetrated by several regularly spaced apart, elongated slits. Corresponding fastener orifices penetrate the frame walls adjacent the slits.

A selectively displaceable clip resides in each slit. The slit divides the clip into an interior base section and an exterior gripping section. The clip base mates with an appropriate, conventional threaded fastener extending through the frame. The fastener permits an operator to displace the clip outwardly and inwardly to selectively tension the safety guards. The clip gripping section defines an arcuate cradle that captivates a portion of a safety guard. A transverse notch in each cradle captivates another portion of the guard to firmly seat it in the locking cradle. The clips permit the guards to be appropriately tensioned when necessary.

The frame encloses an internal, air compressive venturi fitting attached to the interior of the frame walls by screws or welds or other conventional securing devices. The subframe permanently attaches to the venturi and to the walls of the housing in a similar fashion. The subframe comprises a pair of spaced apart, generally parallel elongated brackets. The brackets are preferably oriented vertically. Each bracket is penetrated by several equidistantly spaced, elongated follower slots.

A mounting chassis is used to mount the drive motor and other internal components in the housing. The chassis comprises a base plate extending between a pair of integral, slotted sides. The chassis is selectively positioned between the brackets and then appropriate bolts or other conventional attachment followers are used to secure the slotted sides to the follower slots on each bracket. Each chassis base is penetrated by several mounting slots so that the chassis may easily accept a wide variety of drives, fan propellers, bearings and pulleys. In a direct drive fan configuration, only one chassis is required to mount the motor and propeller. In a belt-driven fan configuration, two mounting chassis are used. One chassis supports the drive motor while the other supports the fan propeller.

An optional automatic tensioning system may be used with belt-driven fans. Two L-shaped catches cooperate with two springs to automatically maintain continuous tension on the belt. One catch mounts in each bracket while a spring extends from the catch to each side of the selected chassis. Thus, one chassis is pulled away from the other chassis to maintain the proper belt tension to ensure peak fan performance.

Thus, a primary object of this invention is to produce an improved fan of the character described whose parts are modular and standardized to simplify assembly and whose parts, once assembled, synergistically reinforce the entire fan.

A related object of the invention is to produce a fan of the character described whose construction details lead to higher manufacturing precision. It is a feature of the invention that the structure disclosed insures interchangeability among different sizes of components.

Yet another object of this invention is to produce an improved fan that can be conveniently and quickly serviced.

It is another important object of this invention to produce a fan of the character described with a pair of tensionable guards that install easier, contribute to overall strength and integrity, and which yield a rugged but esthetically attractive product.

A general object of this invention is to provide a fan of the character described that is easy to service in the field and that saves both production and maintenance time.

Another general object is to provide a fan that will accept drive-belts having different lengths.

A still further object is to provide a fan that is readily capable of use either inside or outdoors.

Another object is to provide a fan of the character described that totally isolates all rotating blades within a safe, protected shroud to avoid direct human contact.

A related object of the invention is to provide a fan with guards that may be conveniently tensioned when desirable.

Another fundamental object of the present invention is to produce a belt-driven fan of the character described that maintains optimum belt tension to ensure peak fan operating efficiency.

A related object is to provide a belt tensioning device that works automatically.

Yet another object of the present invention is to provide a fan housing that maintains its alignment and balance even if parts differently sized from the originals are installed during servicing.

A related object is a fan that reduces noise and vibrations, thus lowering service costs.

Another fundamental object of the present invention is to provide a fan that may be easily serviced by a someone with very little experience in fan maintenance.

A basic object of the present invention is to provide a housing that is readily adaptable to receive a belt-driven or a direct drive fan motor.

A related object of the present invention is to provide a fan of the character described that enables pulleys with varying diameters to be installed quickly.

These and other objects and advantages of the invention, along with features of novelty appurtenant thereto, will appear and become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 3:
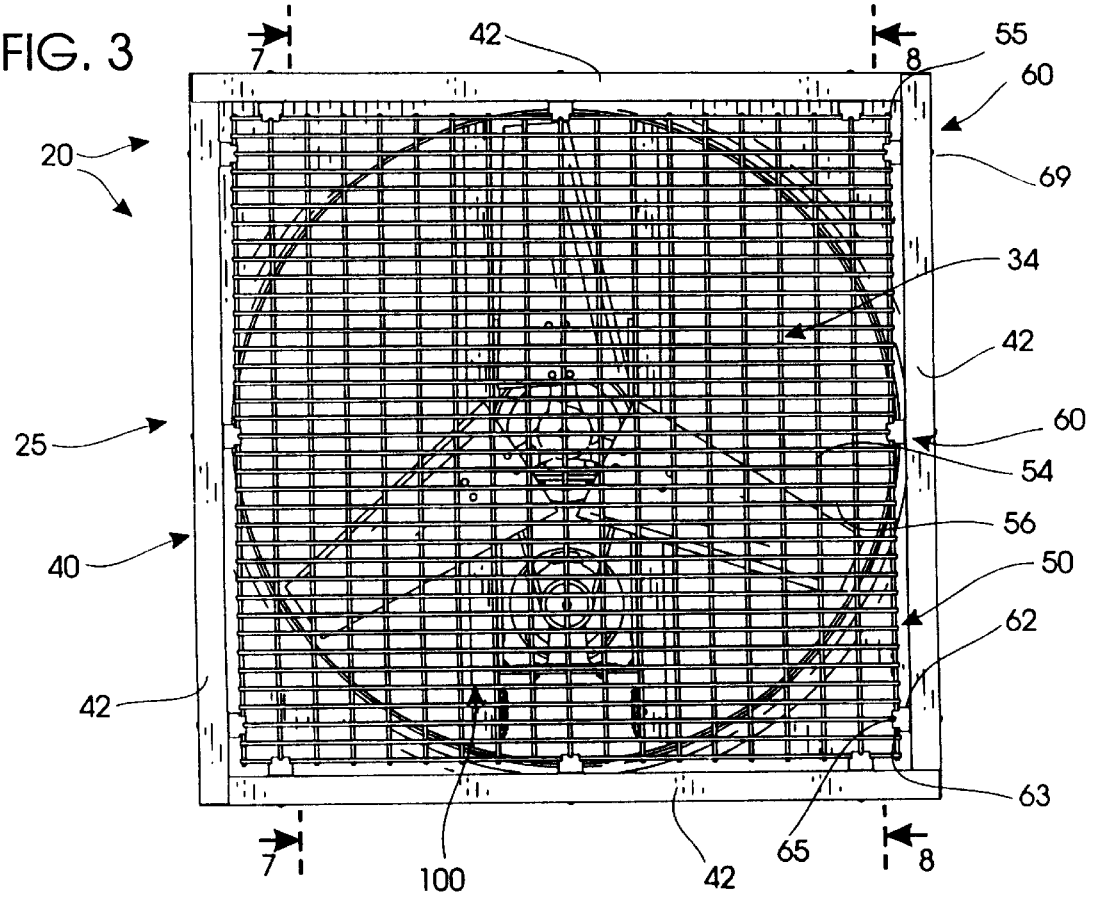
FIG. 3 is a front elevational view.
Figure 4:
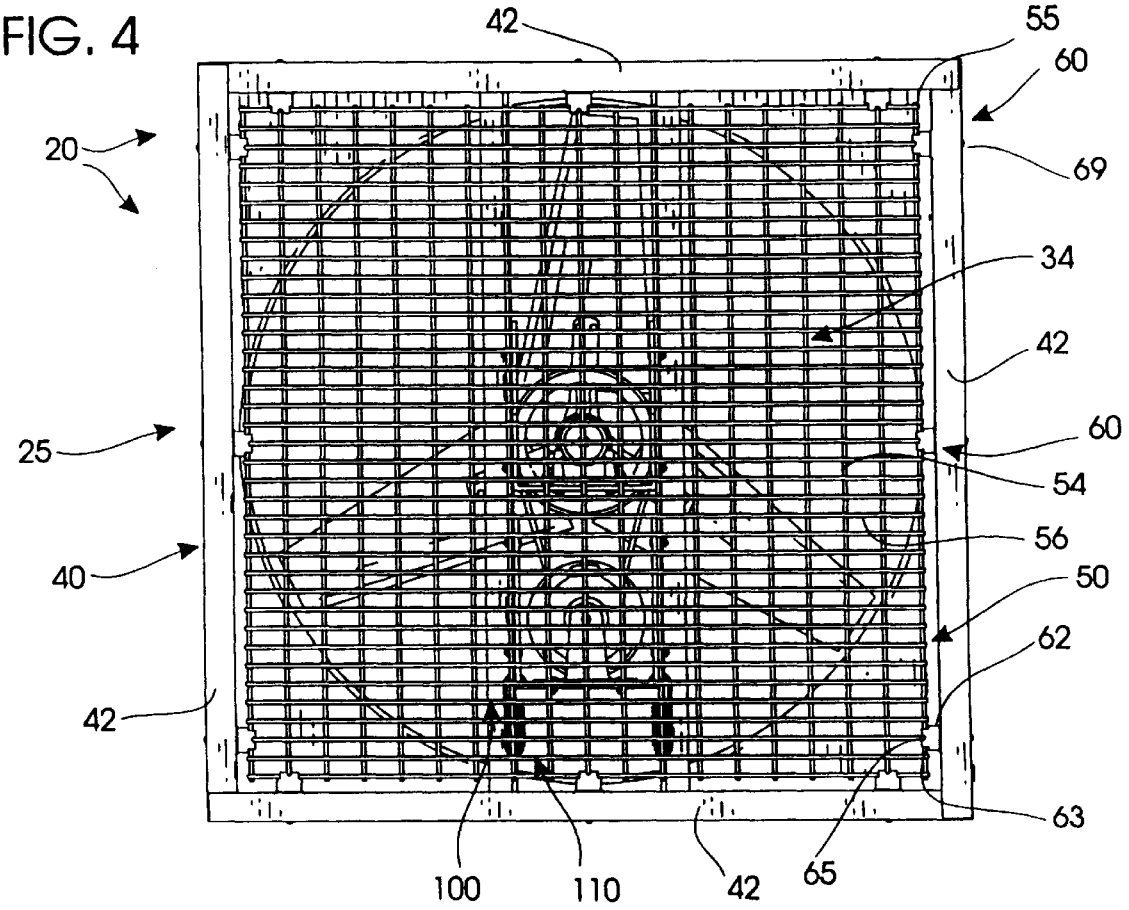
FIG. 4 is a rear elevational view.
Figure 5:
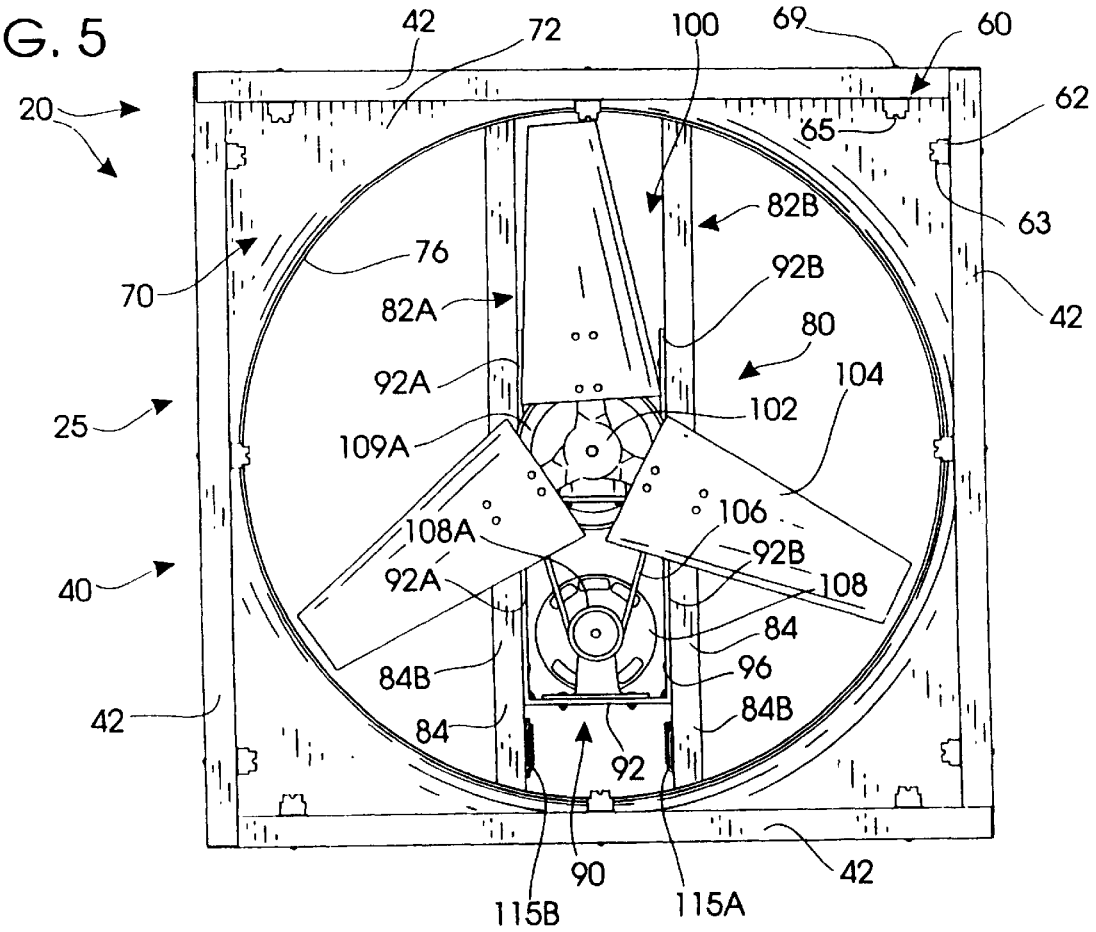
FIG. 5 is a partially fragmented, front elevational view similar to FIG. 3 but with the front guard omitted for clarity.
Figure 6:
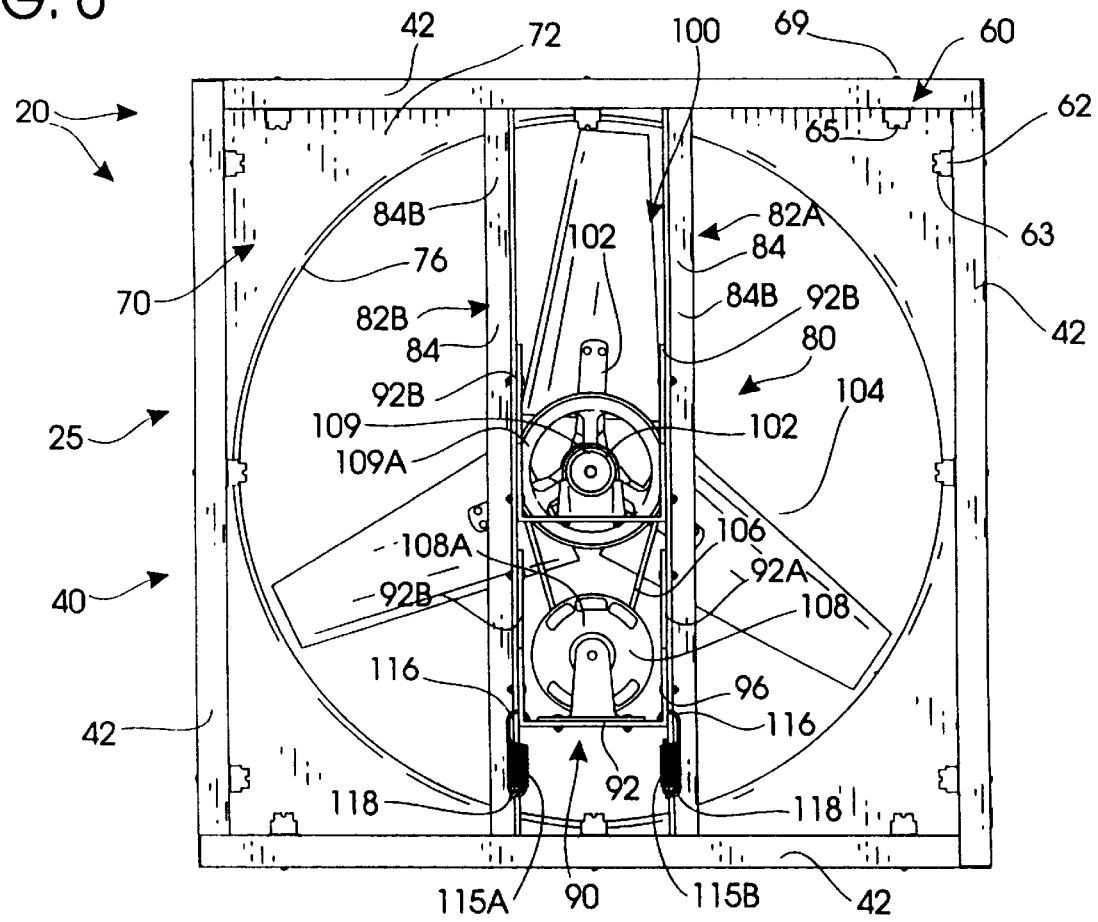
FIG. 6 is a partially fragmented, rear elevational view similar to FIG. 4 but with the rear guard omitted for clarity.
Figure 7:
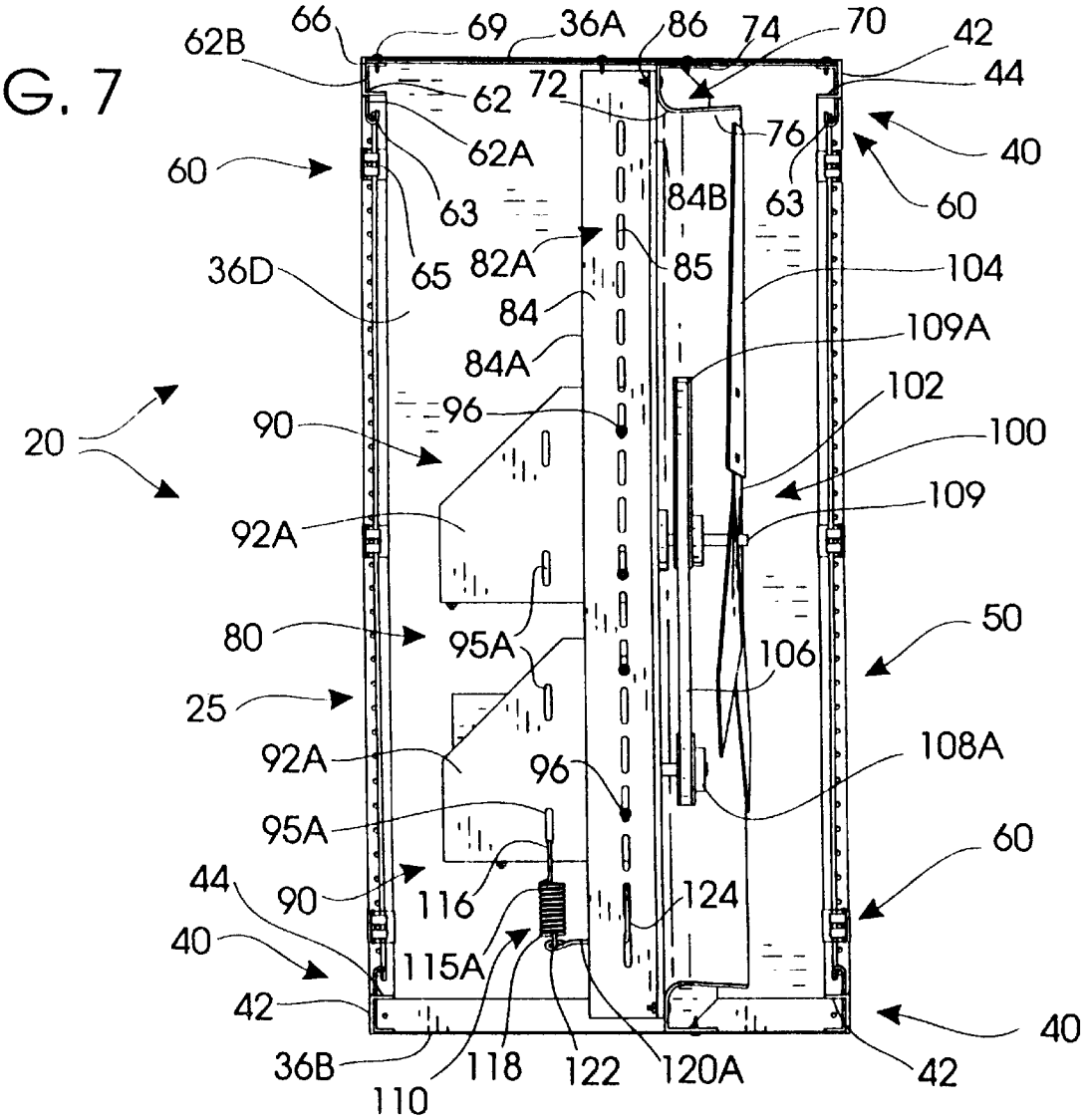
FIG. 7 is a cross-sectional view taken along line 7—7 of FIG. 3, with portions of the housing and guard omitted or broken away for clarity.
Figure 8:
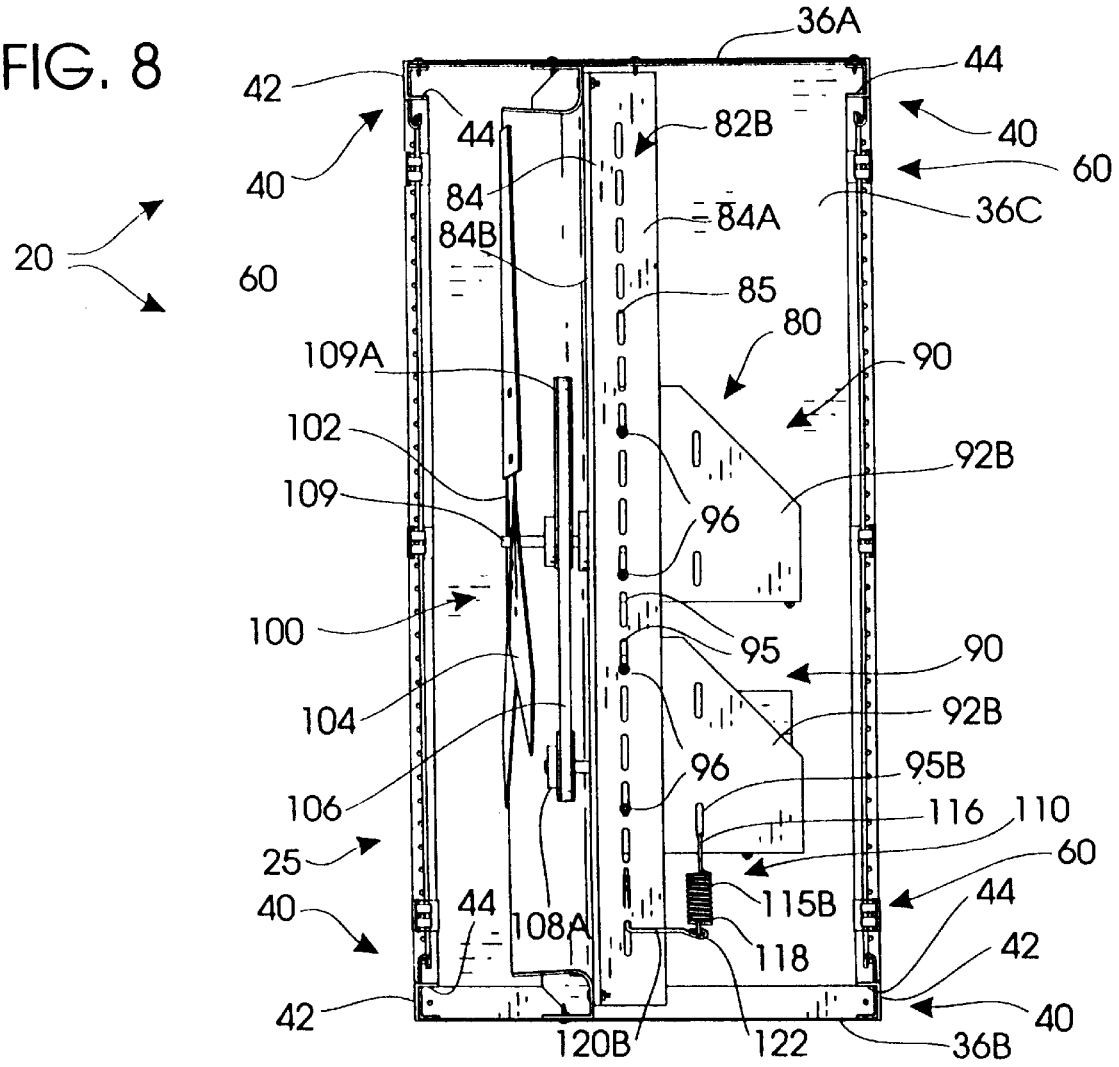
FIG. 8 is a cross-sectional view taken along line 8—8 of FIG. 3, with portions of the housing and guard omitted or broken away for clarity.

With initial reference directed to FIGS. 1–14, my improved fan is generally designated by the reference numeral 20. Fan 20 comprises a generally elongated, preferably tubular housing 25 defining an internal fluid flow channel for the passage of cooling air therethrough. Preferably, housing 25 comprises a generally cubic frame 30. Frame 30 separates an air intake end 32 from a high velocity air output end 34 (FIGS. 3–4). The frame 30 protectively encloses several internal fan components 35, including the motor, fan blades, etc.

In a preferred embodiment, frame 30 comprises a rigid, parallelepiped, box-like assembly. Frame 30 has a spaced apart parallel top and bottom wall 36A and 36B and spaced apart parallel side walls 36C and 36D. Walls 36A–D cooperatively define a hollow, fluid flow channel therebetween.

The walls 36A–D are penetrated adjacent each end 32, 34 by several spaced apart orifices 38. Frame walls 36A–D are also bounded by a reinforcing edge 40 adjacent each end 32, 34. Edge 40 comprises an angular brace 42. Brace 42 defines an adjacent retaining lip 44. Several elongated slits 46 penetrate the lip 44 at regular spaced apart intervals. The wall orifices 38 preferably register with lip slits 46 (FIGS. 5–8).

Figure 1:
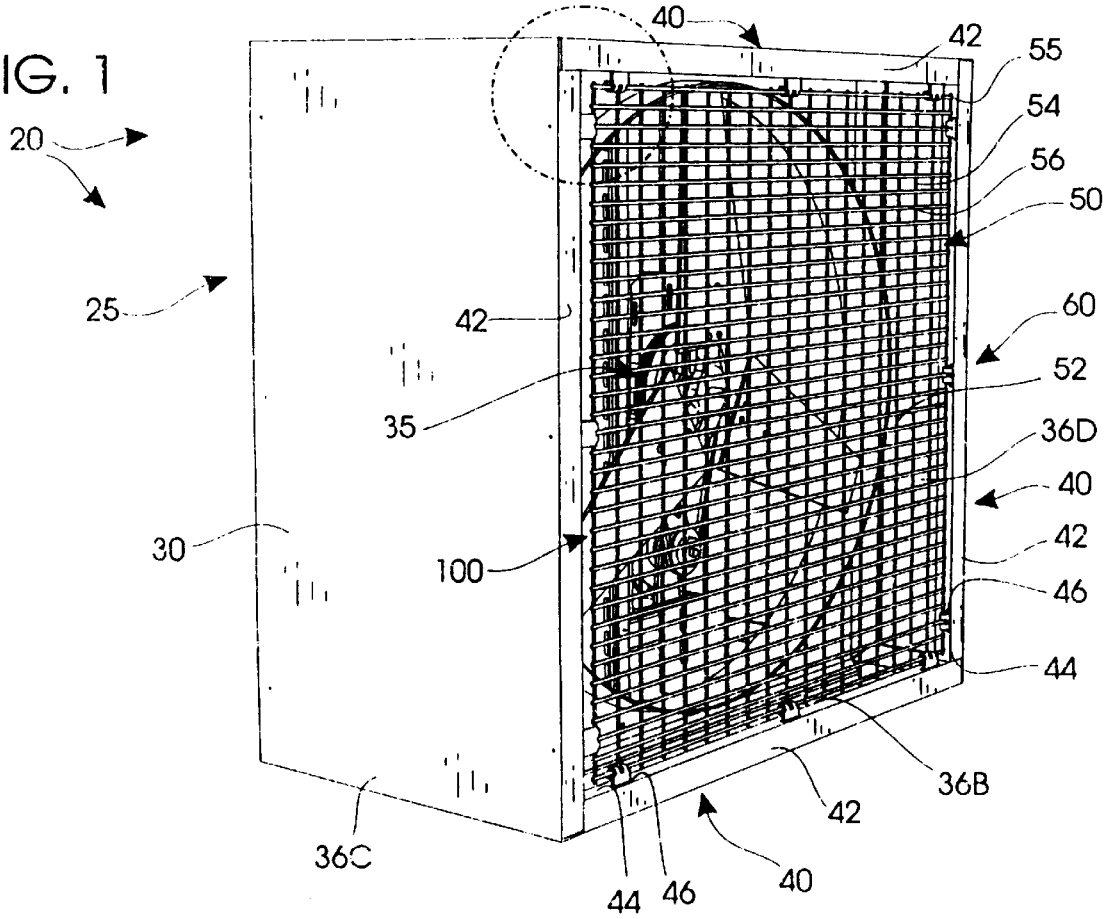
FIG. 1 is an isometric view of an improved fan constructed in accordance with the best mode of the invention, taken generally from the front.
Figure 2:
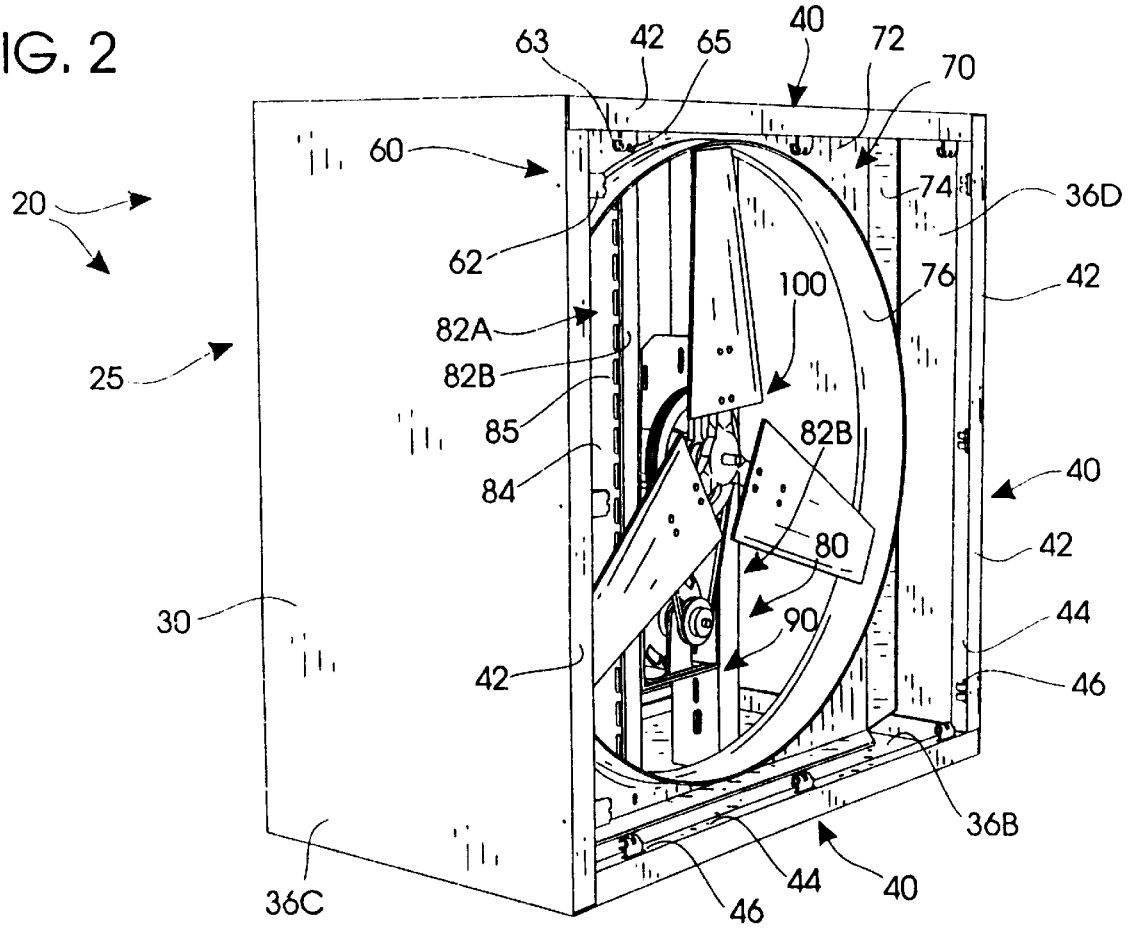
FIG. 2 is a partially fragmented, isometric view similar to FIG. 1 but with the front safety guard omitted for clarity.

A removable safety guard 50 substantially obscures each end 32, 34 (FIG. 1). Guard 50 comprises a substantially rectangular wire mesh 52 that prevents inadvertent contact with internal fan components 35. Wire mesh 52 comprises a series of inner, horizontal filamentary members 54 crossed by another series of vertical filamentary members 56. Thus, criss-crossed members 54, 54 cooperatively form mesh 52. Members 54 and 56 are bounded by an integral peripheral outer member 55.

Guard 50 is coupled to frame 30 by a plurality of selectively displaceable gripping clips 60. Each clip 60 resides in a slit 46. Each clip 60 comprises an elongated body 62. The slit 46 roughly divides the body 62 into an exterior gripping section 62A and an interior base section 62B.

Figure 9:
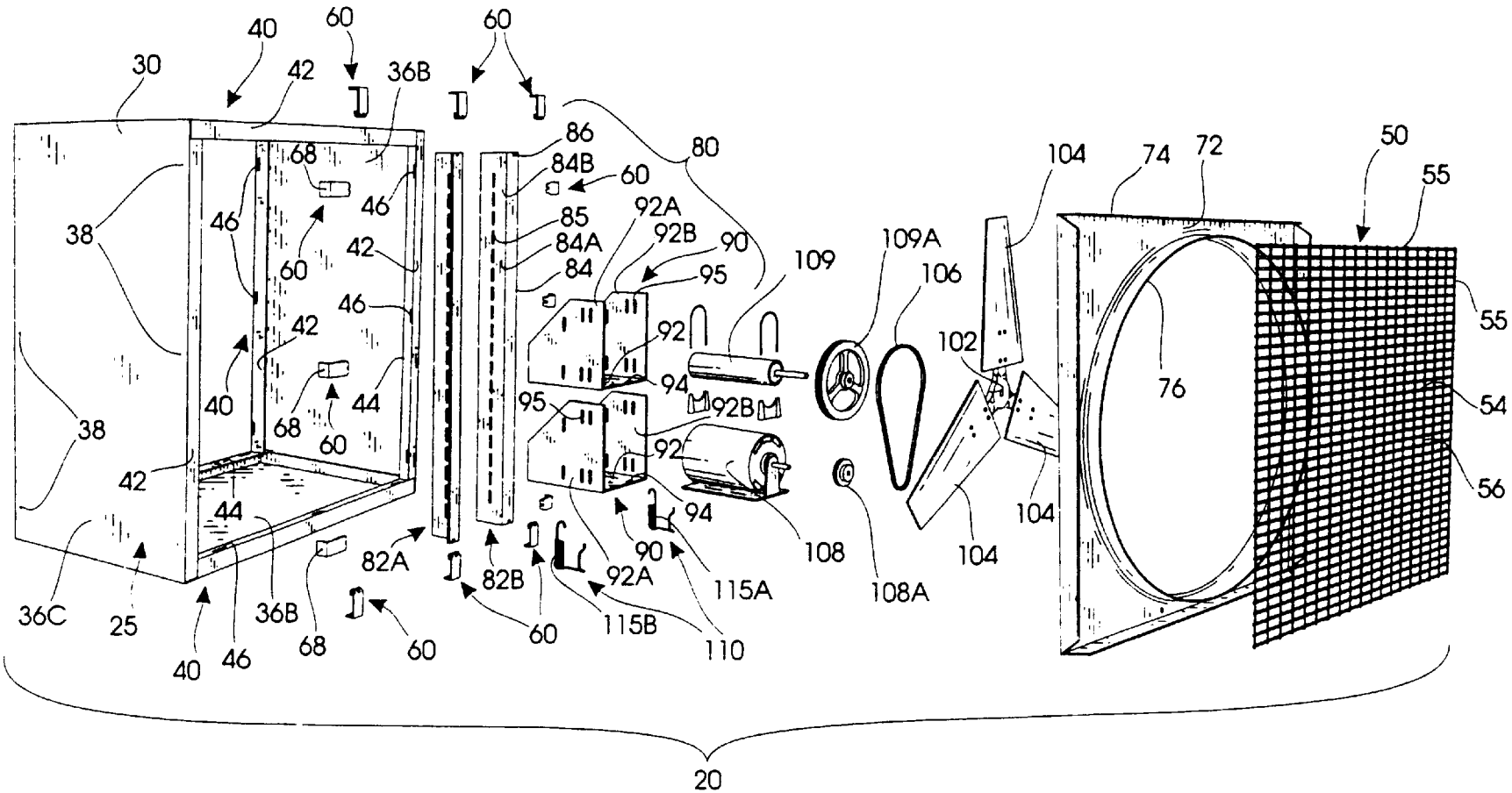
FIG. 9 is a partially exploded, pictorial view of the fan, including the internal components and the front safety guard, with portions omitted or broken away for clarity.
Figure 13:
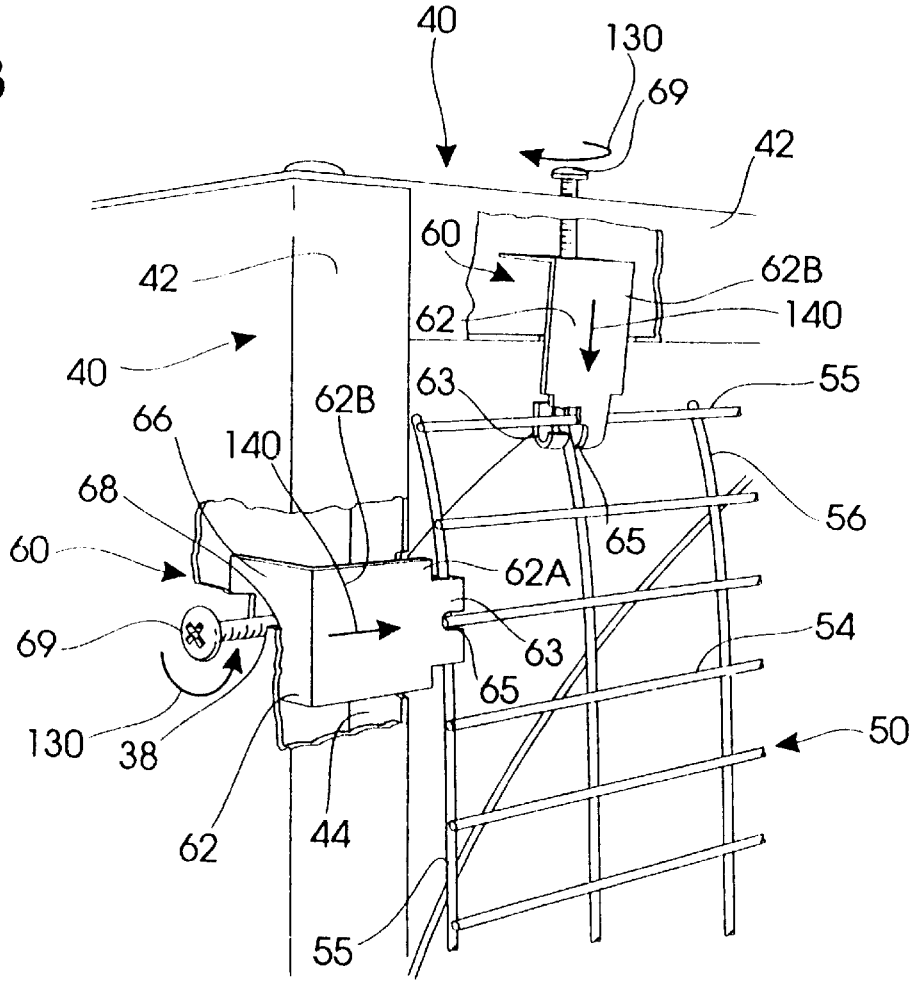
FIG. 13 is an enlarged, partially fragmented view of the encircled portion of FIG. 1 showing the safety guard after being partially loosened but while still seated in the cradle immediately prior to guard removal from the housing, with portions omitted or broken away for clarity; and, FIG. 14 is an enlarged, partially fragmented view similar to FIG. 13, but showing the safety guard after tightening to firmly seat the safety guard in the cradle and notch and with the clip securing the guard to the housing, with portions omitted or broken away for clarity.
Figure 14:
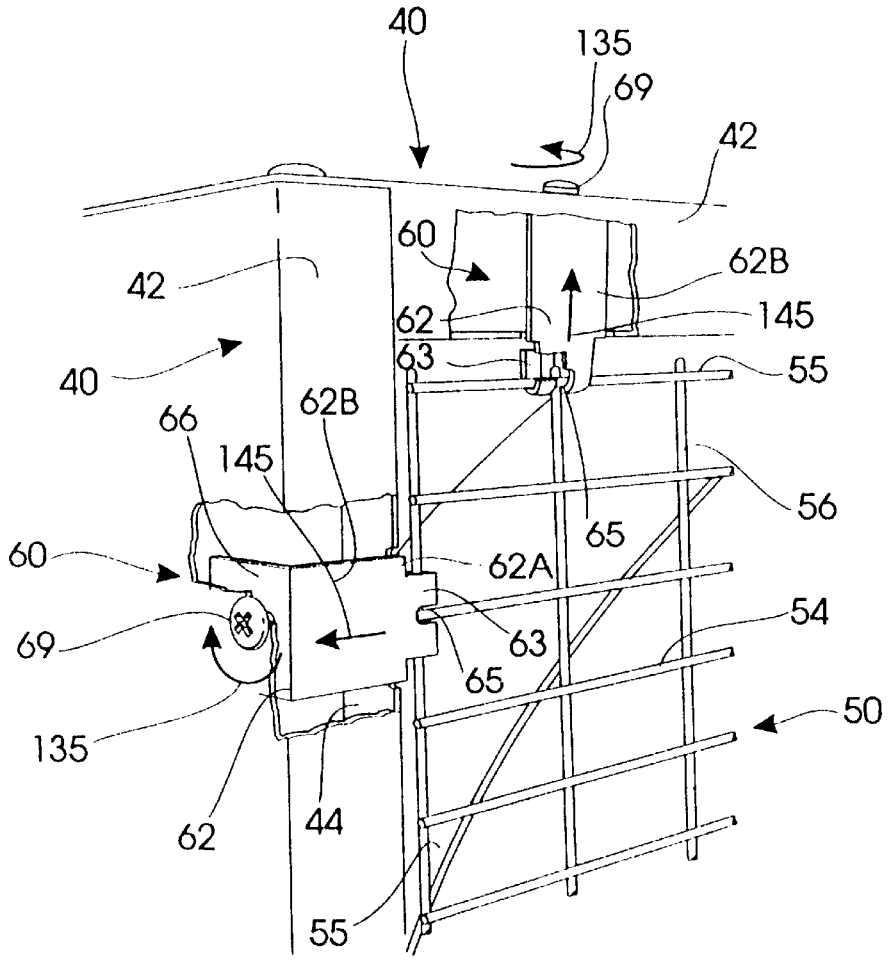

The exterior gripping section 62A primarily comprises a terminal locking cradle 63 (FIGS. 9, 13–14). Cradle 63 is cut by a transverse notch 65 adjacent its midpoint. When a clip 60 is used to couple a guard 50 to the frame 30, cradle 63 captivates a portion of the outer member 55 while notch 65 captivates a portion of inner members 54 or 56. In other words, cradle 63 grips one portion of the guard 50 while notch 65 grips another portion of the guard 50 to lock it in place.

The interior section 62B primarily comprises a terminal flat anchor 66. Anchor 66 is penetrated by a threaded boss 68. A fastener 69 penetrates wall orifice 38 to mate with boss 68. The fastener 69 may be any appropriately threaded fastener such as a conventional screw or bolt. The fastener 69 permits an operator to displace the clip outwardly and inwardly to selectively tension each safety guard 50 (FIGS. 13–14). Usually, all of the internal fan components are protected by the frame 30 in conjunction with the two end covering guards 50. However, for service of internal components or for other reasons, the clips 60 permit an operator to selectively tension or even remove one or both of the guards 50.

The internal fan components principally comprise an optional venturi fitting 70, mounting subframe 80, drive motor 108 and propeller 90 (FIGS. 9–12). The venturi fitting 70 primarily comprises a funnel 72. Funnel 72 has a rectangular outer flanged periphery 74 and an interior, conic spout 76. The spout 76 compresses the input air into a high velocity output stream. The outer funnel periphery 74 is permanently attached to the walls 36A–D of the frame by screws or other conventional attachment devices.

The subframe 80 primarily comprises a pair of spaced apart brackets 82A, 82B that support at least one mounting chassis 90. Brackets 82A, 82B preferably extend between the frame top 36A and the bottom 36B adjacent venturi fitting 70. The brackets 82A, 82B cooperatively support mounting chassis 90 as described in more detail hereinafter. Each bracket comprises an elongated column 84. The inner column face 84A is penetrated by a plurality of regularly spaced apart follower slots 85. The outer column face 84B is penetrated at the top and bottom by appropriate attachment holes 86 for screws or bolts, etc.

The mounting chassis 90 comprises a flat base plate 92 with integral sides 92A, 92B. A preselected number of attachment slots 94 penetrate base plate 92. Several regularly spaced apart follower slots 95 penetrate the sides 92A, 92B. When the chassis is mounted between brackets 82A, 82B, the side follower slots 95 register with bracket follower slots 85. Several bolts 96 or other conventional attachment apparatus may then be used to securely mount the chassis 90 between the brackets 82A, 82B.

Figure 11:
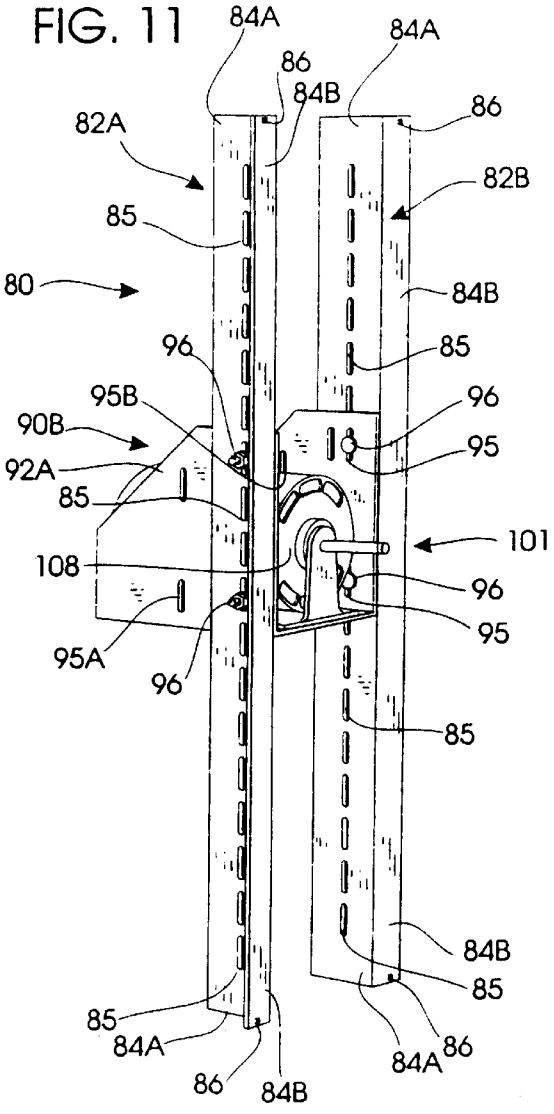
FIG. 11 is a partially fragmented, side elevational view of an alternative configuration for the subframe assembly with portions of the housing and guard omitted or broken away for clarity.
Figure 10:
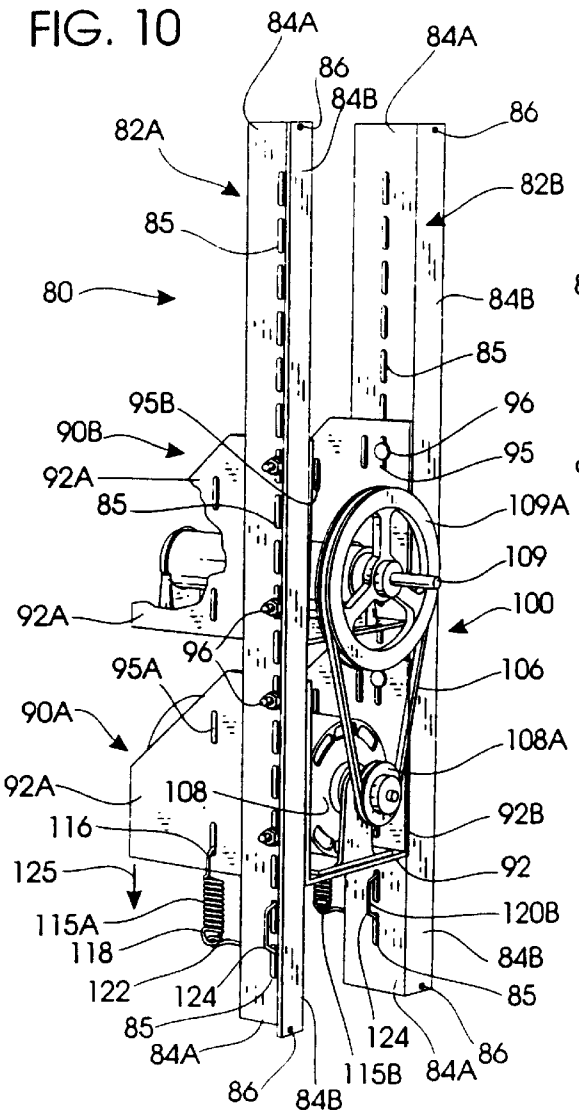
FIG. 10 is a partially fragmented, side elevational view of the preferred configuration for the subframe assembly with portions of the housing and guard omitted or broken away for clarity.
Figure 12:
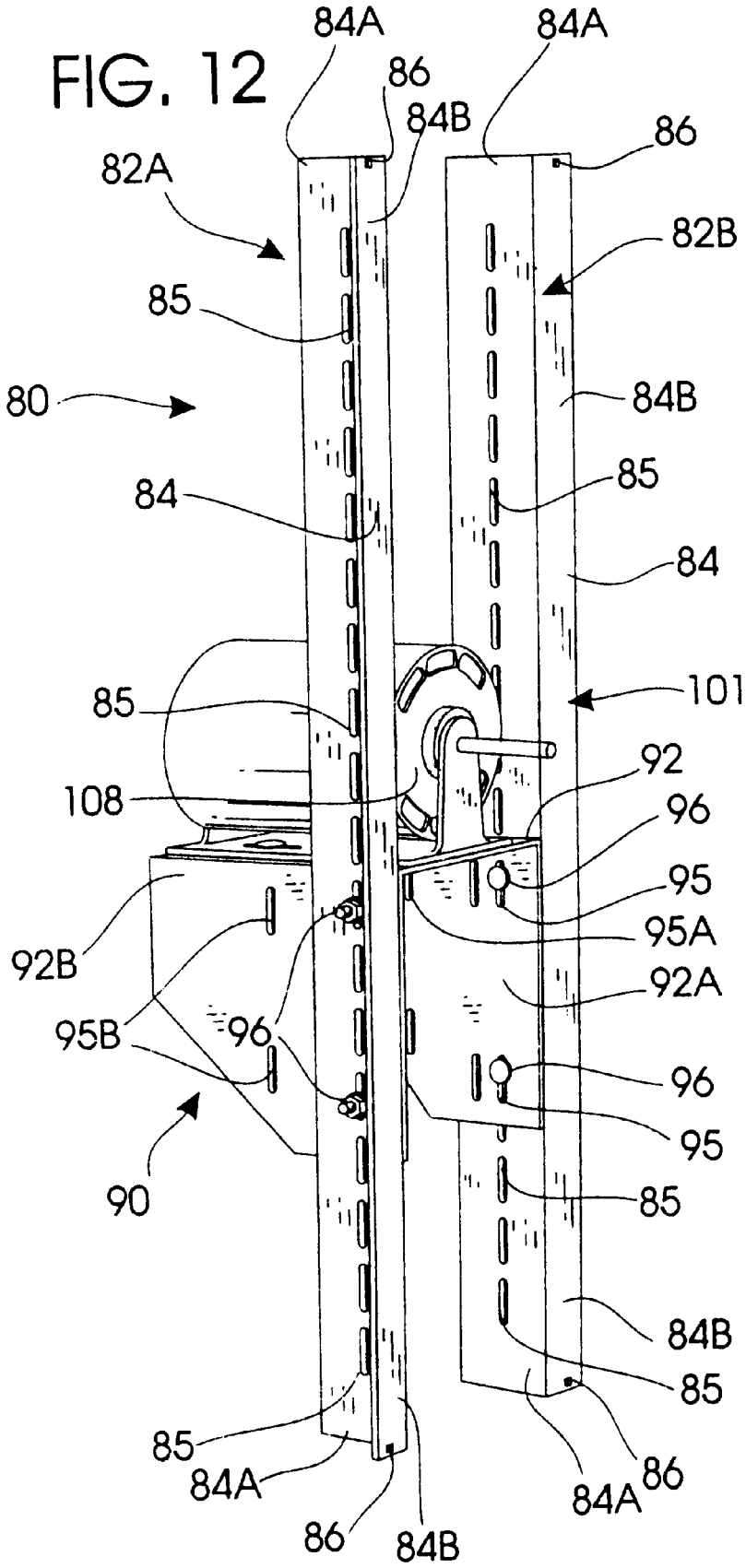
FIG. 12 is a partially fragmented, side elevational view of a second alternative configuration for the subframe assembly with portions of the housing and guard omitted or broken away for clarity.

During assembly, the fan may be selectively configured as a belt driven fan 100 (FIGS. 9–10) or as a direct drive fan 101 (FIGS. 11–12). Both fans selectively rotate a propeller 102 with arcuate blades 104 to generate high velocity cooling air. However, only one mounting chassis 90 is needed for direct drive fans while two chassis are required for belt driven fans.

In the preferred embodiment, the bracket follower slots 85 and the chassis follower slots 95 are appropriately sized so that they may overlap. Such an overlap permits the chassis 90 to be infinitesimally adjusted along the brackets 82A, 82B to facilitate the use of a wide variety of propeller sizes as well as motor sizes.

In belt driven fans, the belt is generally rotated by a motor 108 via pulley 108A. The belt is entrained about bearing 109 via pulley 109A. On the other hand, in a direct drive fan, the motor 108 directly drives the propeller 102.

In a particularly preferred belt-driven fan embodiment (shown in FIG. 10), the subframe 80 also permits the adjustment of one chassis 90A relative the other chassis 90B to automatically tension the belt 106. The optional, automatic tensioning system 110 shown therein comprises a pair of springs 115A, 115B hooked between sides 92A, 92B and brackets 82A, 82B by two generally L-shaped catches 120A, 120B.

Each spring 115A, 115B comprises spaced apart terminal ends 116, 118. End 116 hooks into a selected rear slot 95A or 95B on sides 92A, 92B respectively. The other end 118 hooks into catch 120A or 120B at terminal catch loop 122. The other end of each catch forms an elongated rod 124. Each catch rod 124 is adapted to be inserted into an appropriate bracket follower slot 85. In the preferred embodiment, bolts 96 use self-locking nuts to secure chassis 90A to brackets 82A, 82B while chassis 90B is fixedly mounted. Thus, chassis 90A may move relative to chassis 90B, as shown by arrow 125 in FIG. 10, to automatically tension the belt 106.

Guard Tensioning and Fan Service

The guards 50 may be selectively tensioned as necessary by simply loosening or tightening fasteners 69, shown by the arrows 130, 135 respectively (FIGS. 13–14). As each fastener 69 is loosened or tightened, the clip 60 it mates within is correspondingly loosened or tightened, shown by arrows 140, 145.

Since fan maintenance generally requires the removal of at least one guard 50, the above process can be easily implemented to remove a guard. The operator simply unscrews all necessary fasteners 69 to loosen all of the clips 60 that couple the selected guard 50 to the frame 30. The fan may then be conveniently serviced. As has been mentioned hereinbefore and as is seen from the drawings, subframe 80 is infinitely adjustable to accept multiple motors, bearings, pulleys, propellers, blades, belts, etc. Thus, the fan may be easily serviced by persons with minimal levels of experience and with a minimum of replacement parts.

Reinstalling the guard 50 is the reverse of removal. The operator simply places the guard periphery 55 in the cradle 63. The notch permits vertical members 56 or horizontal members 54 to remain rigid while the periphery 55 seats in cradle 63.

From the foregoing, it will be seen that this invention is a one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A ventilation fan comprising:

a rigid, generally cubical, housing comprising an air intake end and a high velocity air output end;

a propeller disposed within said housing;

motor means for rotating the propeller;

subframe means for mounting said motor means and said propeller within said housing, said subframe means comprising:

a first elongated bracket comprising a plurality of regularly spaced follower slots;

a spaced apart and parallel, second elongated bracket comprising a plurality of regularly spaced follower slots, said slots aligned with said first bracket slots; and, universal chassis means secured between said first and second brackets for securing said motor means, said chassis means comprising slotted sides adapted to register with said first and second bracket follower slots;

a pair of selectively removable guards;

a plurality of slits defined in said housing;

clip means penetrating said slits for coupling said guards to said housing; and, threadable adjustment means for loosening and tightening said clips.

2. The ventilation fan as defined in claim 1 wherein said chassis means comprises a pair of separate, vertically spaced apart upper and lower chassis members, one of said chassis members supporting said motor and the other of said chassis members supporting said propeller.

3. The ventilation fan as defined in claim 2 wherein each chassis member comprises a central base integral with said chassis sides, said base comprising a plurality of regularly spaced apart mounting slots for adjustably mounting said motor means and said propeller.

4. The ventilation fan as defined in claim 1 further comprising:

belt means for transferring rotary movement from said motor to said propeller; and, spring means for automatically tensioning said belt by biasing one of said chassis members away from the other of said chassis members.

5. The ventilation fan as defined in claim 1 wherein said clip means comprises an arcuate locking cradle adapted to captivate a portion of said guard, wherein said cradle comprises a transverse notch adapted to captivate another portion of said guard.

6. The ventilation fan as defined in claim 5 wherein said chassis means comprises a pair of separate, vertically spaced apart upper and lower chassis members, one of said chassis members supporting said motor and the other of said chassis members supporting said propeller.

7. The ventilation fan as defined in claim 6 wherein each chassis member comprises a central base integral with said chassis sides, said base comprising a plurality of regularly spaced apart mounting slots for adjustably mounting said motor means and said propeller.

* * * * *